US006361251B1

(12) United States Patent
Soltanahmadi et al.

(10) Patent No.: US 6,361,251 B1
(45) Date of Patent: Mar. 26, 2002

(54) APPARATUS FOR AND A METHOD OF SUPPORTING A TUBULAR MEMBER

(75) Inventors: Abbasali Soltanahmadi, deceased, late of Aberdeen; by Joanne Elisabeth Soltanahmadi, executrix, Bishopthorpe, both of (GB)

(73) Assignee: Stolt Offshore Limited (GB)

( * ) Notice: Subject to any disclaimer, the term of this patent is extended or adjusted under 35 U.S.C. 154(b) by 0 days.

(21) Appl. No.: 09/446,990

(22) PCT Filed: Jun. 30, 1998

(86) PCT No.: PCT/GB98/01909

§ 371 Date: Dec. 29, 1999

§ 102(e) Date: Dec. 29, 1999

(87) PCT Pub. No.: WO99/01538

PCT Pub. Date: Jan. 14, 1999

(30) Foreign Application Priority Data

Jul. 1, 1997 (GB) ..... 9713813
Jul. 3, 1997 (GB) ..... 9713987

(51) Int. Cl.[7] ..... E21B 19/00
(52) U.S. Cl. ..... 405/170; 166/75.14; 166/85.5
(58) Field of Search ..... 405/154, 161, 405/158, 169, 170; 166/75.11, 85.1, 85.5, 79.1, 75.14

(56) References Cited

U.S. PATENT DOCUMENTS 1,660,708 A 2/1928 Grant
4,209,066 A 6/1980 Watson ..... 166/315
4,417,846 A 11/1983 Elliston ..... 414/745
4,834,441 A 5/1989 Schivley ..... 294/90
5,083,356 A 1/1992 Gonzalez et al. ..... 24/429
5,221,099 A 6/1993 Jänsch ..... 279/151
5,458,441 A 10/1995 Barry ..... 405/170
6,070,912 A * 6/2000 Latham
6,179,523 B1 * 1/2001 Langner et al.

FOREIGN PATENT DOCUMENTS

DE 40 15 300 C1 1/1992

OTHER PUBLICATIONS

McKeehan, D.S., "J–Curve Pipeline Installation Practical Issues," Offshore Technology Conference, May, 1991, pp. 303–310.

* cited by examiner

*Primary Examiner*—Roger Schoeppel
(74) *Attorney, Agent, or Firm*—Sheridan Ross P.C.

(57) ABSTRACT

An apparatus for and a method of supporting a tubular member in a vertical orientation are provided. A first and length of pipe (1, 4) are supported at their upper ends by detachable collars (2*a,* 2*b*). The detachable collars (2*a,* 2*b*) are engageable with collar flanges (3*a,* 3*b*) which are attached to the pipes (1, 4). A pipe string elevator (5) is used to support the pipe (4) while an operator (70) attaches the lower end of pipe (4) to the upper end of the flange collar (3*a*).

33 Claims, 6 Drawing Sheets

APPARATUS FOR AND A METHOD OF SUPPORTING A TUBULAR MEMBER

FIELD OF THE INVENTION

The invention relates to apparatus for and a method of supporting a tubular member, such as a length of pipe, in a vertical orientation.

DESCRIPTION OF RELATED ART

It is known to install an underwater pipeline from a drill rig by what is known as a "J-lay" method. In this method of installation lengths of pipe are supported vertically while the individual lengths are welded together. The welded pipe is subsequently lowered towards the seabed through the rotary table on the drill rig. Thus, the pipe is lowered vertically from the drill rig and curves towards a generally horizontal orientation on the seabed.

SUMMARY OF THE INVENTION

The most convenient method of installing pipeline by a drilling rig is to attach a flange (or J-lay) collar to the pipe, and use the J-lay installation method. However, there are problems in using this method to install Steel Catenary Risers (SCR) which are attached to a floating production system such as a semi-submersible or a Floating Production Storage and Offloading vessel (FPSO). This problem is caused by the motion of the vessel and environmental loading during the operational lifetime of the SCR. Both of these may cause undesirable stressing at the stress concentrated locations adjacent to the collar flange attachments. This effect becomes more severe in harsher environmental conditions and stress levels become unacceptable due to the fatigue life limitation.

Installation of a SCR using the J-lay collar was performed in the Gulf of Mexico with a Tensioned Leg Platform (TLP). In a TLP, although the platform is semi-submersible, the platform is secured to the sea bed by tethers which are in tension between the sea bed and the platform. Hence, the tension in the tethers helps to minimise the lateral movement of the TLP and substantially eliminates the vertical movement. In addition, the sea state in the Gulf of Mexico is generally calm which also helps to minimise the movement of the TLP.

However, this arrangement for installation of SCRs is not suitable for a floating production system which incorporates anchor lines. In this type of platform, the movement of the platform can result in high flexing of the pipes which produces high cyclic stress loading in the area of the flanges which can potentially result in failure of the pipe. In addition, the arrangement is also unlikely to be suitable for a TLP in sea conditions more adverse than the Gulf of Mexico, such as the North Sea, where the movement of a TLP would be greater and could result in fatigue and failure of the pipe due to the high stress zones around the flanges attached to the pipe.

In accordance with a first aspect of the present invention, there is provided apparatus for supporting a tubular member comprising a first member comprising a first formation, the first member being adapted to be attached to the tubular member, and a detachable member adapted to engage the first formation; the detachable member having an internal formation which engages with the first formation, and an external formation for engagement by a lifting device to support the tubular member when the detachable member is placed against the tubular member and the internal formation is engaged with the first formation.

Preferably, the detachable member is also adapted to engage the tubular member adjacent the first formation.

In accordance with a second aspect of the present invention, there is provided a method of supporting a tubular member comprising attaching to the tubular member a first member comprising a first formation, placing a detachable member against the first formation so that the first formation engages an internal formation on the detachable member; and engaging an external formation on the detachable member with a lifting device to support the tubular member.

Optionally, the detachable member is also placed around a portion of the tubular member adjacent the first formation.

The first member typically comprises a collar and is typically coupled to the tubular member by any conventional means, such as by welding. The first formation can be in the form of a protrusion on the collar.

The detachable member is typically engageable with the collar.

An advantage of the invention is that by using a detachable member to engage with a first formation attached to the tubular member, it is possible to reduce the size of the first formation and therefore, decrease the stress concentration in the pipe adjacent to the first formation.

Preferably, the method further comprises the step of fixing the tubular member or the first member to another tubular member and subsequently detaching the detachable member from the first tubular member.

Preferably, the tubular member is supported with the central longitudinal axis of the tubular member in a substantially vertical orientation.

In accordance with a third aspect of the present invention, there is provided a method of laying underwater pipeline comprising a method of supporting a first tubular member in accordance with the second aspect of the present invention, attaching another tubular member also supported by a method according to the second aspect of the present invention to the first tubular member or the first member, such that the tubular members are in end to end relationship and the central longitudinal axis of the tubular members are substantially coincident, releasing the detachable member against the first formation on the first tubular member, and lowering the tubular members by means of the lifting device attached to the second detachable member to lower the tubular members towards the seabed.

Preferably, the first member may be attached to an end of the tubular member. However, in an alternative example of the invention, it is possible that the first member may be attached to an external surface of the first tubular member. Typically, the first member is attached to the tubular member by a welding operation, and a welding operation may also be used to attach the other tubular member to the first tubular member or the first member.

Preferably, the method of laying an underwater pipeline in accordance with a third aspect of the invention comprises laying the underwater pipeline from a semi-submersible vessel or floating vessel, such as a semi-submersible drilling rig, a floating production platform or a tensioned leg platform.

In one example of the invention, the first formation may be removed from the first member, for example by a reaming or machining operation, after detachment of the detachable member. This may be useful for applications where strictly no stress concentration condition along the SCR is permitted.

In one example of the invention the detachable member may be adapted to rest on a support pedestal located on the drill floor of the platform or vessel. Alternatively, the detachable member may be adapted to engage with and be supported by slips located in a rotary table on the platform or vessel.

Typically, the detachable member is hinged along an axis substantially parallel to the central longitudinal axis of the detachable member and the tubular member. Preferably, when placed around the formation and the portion of the tubular member adjacent to the formation, the detachable member is clamped to the first formation and the portion of the tubular member adjacent the first formation.

BRIEF DESCRIPTION OF THE DRAWINGS

Examples of apparatus for and a method of supporting a tubular member will now be described with reference to the accompanying drawings, in which:

FIG. 2 is an exploded cross-sectional view of the detachable collar of FIG. 1 supported by a travelling block;

FIG. 3 is an exploded cross-sectional view of the detachable collar of FIG. 1 supported by a support pedestal;

FIG. 5 is an exploded cross-sectional view of the detachable collar of FIG. 4 supported by a travelling block;

FIG. 6 is an exploded cross-sectional view of the detachable collar of FIG. 4 supported by slips at a rotary table;

DESCRIPTION OF PREFERRED EMBODIMENTS

Figure 1:
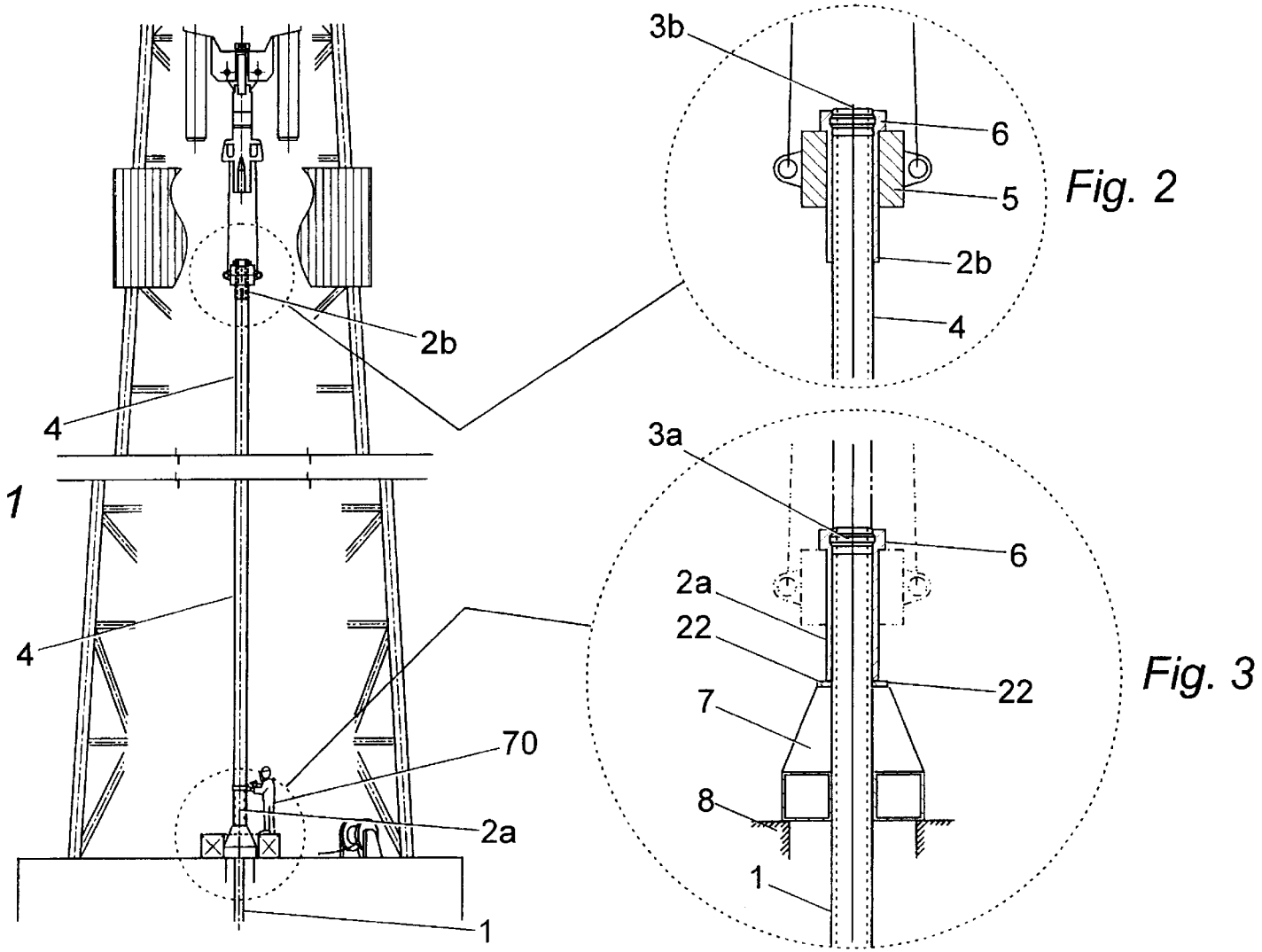
FIG. 1 is a schematic diagram of a general arrangement for supporting a length of pipe using a first example of a detachable collar.

FIG. 1 is a general schematic view showing a pipeline being assembled and laid from a drilling rig using a J-lay technique in which a first length of pipe 1 is supported at its upper end by a detachable collar 2*a* which encircles the upper end of the pipe 1 and engages with a collar flange 3*a* (FIG. 3) welded to the upper end of the pipe 1. A second length of pipe 4 is supported at its upper end by another detachable collar 2*b* which engages round another collar flange 3*b* welded to the upper end of the pipe 4. A pipe string elevator 5 (in this embodiment a hard shoulder bearing type) engages an external flange 6 on the detachable collar 2*b* to support and lift the pipe 4. Exploded views of the upper end of the pipe 4 and the upper end of the pipe 1 are shown in FIGS. 2 and 3 respectively. The pipe string elevator 5 supports the upper pipe 4 by means of the detachable collar 2*b* while an operator 70 welds the lower end of the upper pipe 4 to the upper end of the lower flange collar 3*a*.

After the upper pipe 4 has been welded to the lower flange collar 3*a*, the lower detachable collar 2*a* is detached from the lower flange collar 3*a* and the lower pipe 1. The pipe string elevator 5 then lowers the upper pipe 4 (and the lower pipe 1) through the support pedestal 7 and the rotary table 8 until the lower edge of the upper detachable collar 2*b* rests on the upper edge of the support pedestal (ie when the upper pipe 4 is in the position shown in FIG. 3) A further length of pipe may then be manoeuvred into position above the upper pipe 4 (which now becomes the lower pipe) to permit the further pipe to be welded to the upper flange collar 3*b* on the upper end of the pipe 4.

Figure 8:
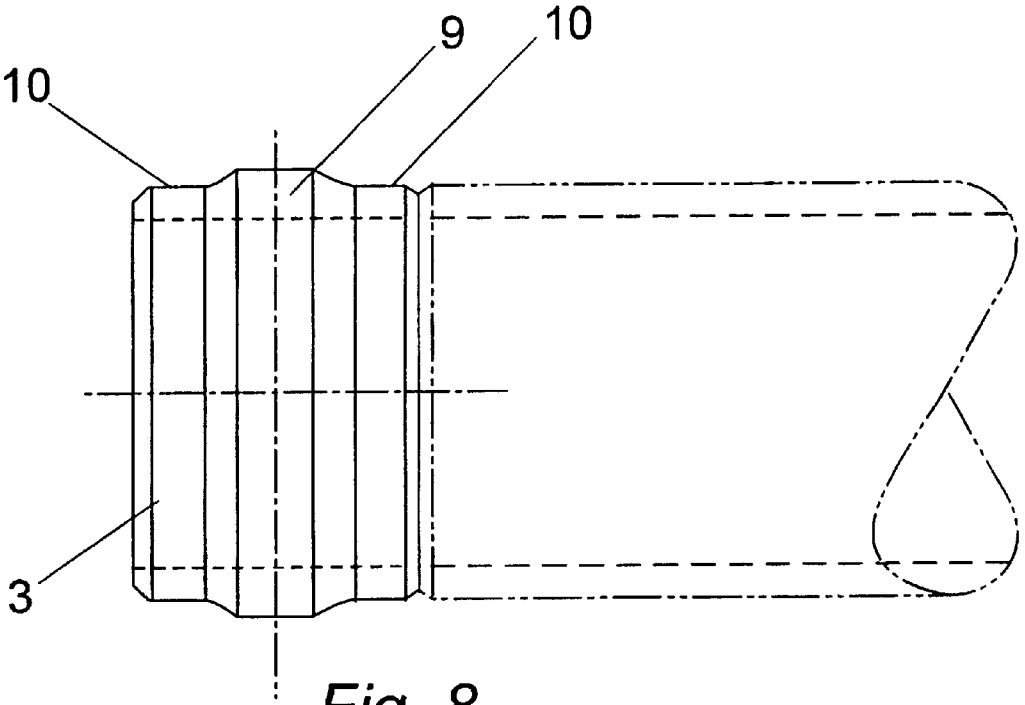
FIG. 8 is a side view showing the collar flange welded to an end of a length of pipe.
Figure 7:
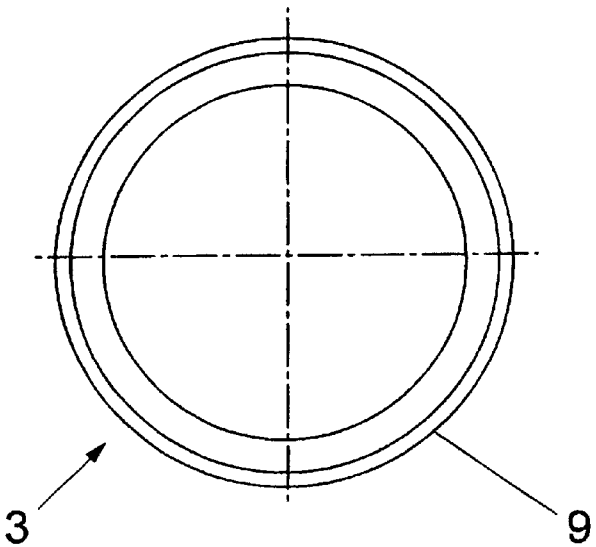
FIG. 7 is an end view of a collar flange for use with the detachable collars shown in FIGS. 1 to 6.
Figure 12:
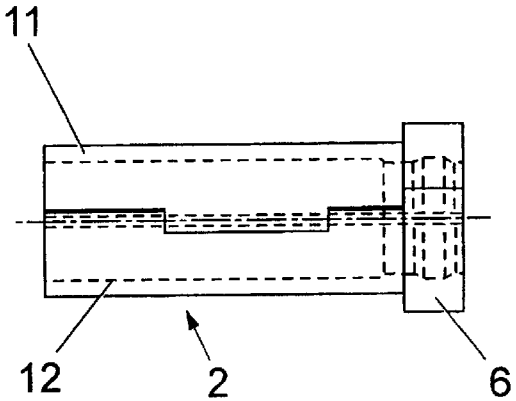
FIG. 12 is a diametrically opposed side view of the detachable collar shown in FIG. 9.
Figure 11:
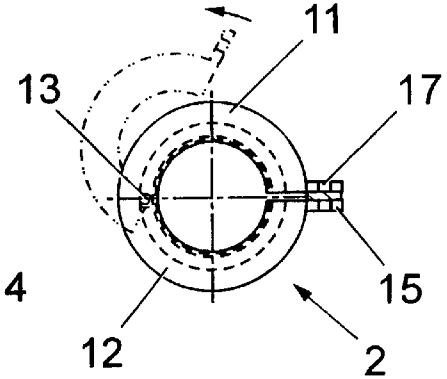
FIG. 11 is an end view of the detachable collar shown in FIG. 9.
Figure 9:
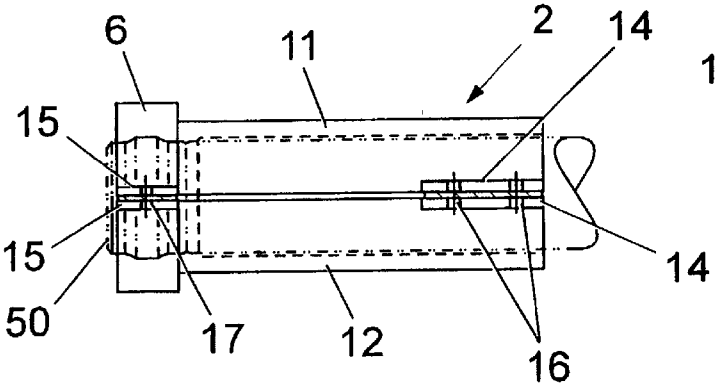
FIG. 9 is a first side view of the detachable collar shown in FIGS. 1 to 3.
Figure 10:
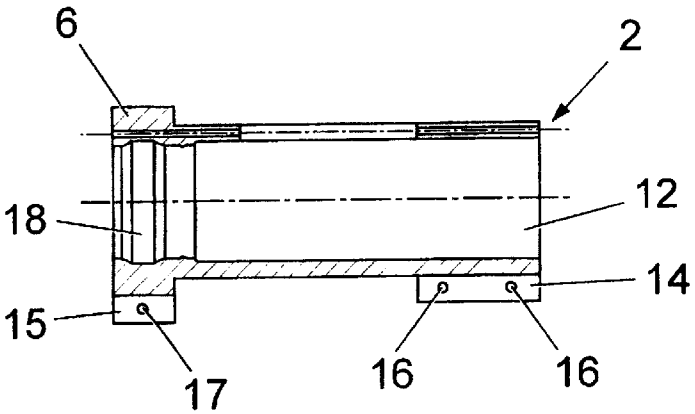
FIG. 10 is a cross-sectional view along the line A—A of FIG. 9.

The flange collar 3 is shown in detail in FIGS. 7 and 8. Collar 3 has an internal diameter similar to the internal diameter of the length of pipe to which it is welded (shown in phantom in FIG. 8). It has external sections 10 of similar outer diameter to the outer diameter of the pipe 1, 4. A formation 9 is located on the external surface of the flange collar 3 and is in the form of a flange which extends circumferentially around the collar 3. The difference in diameter between the formation 9 and the external section 10 is such that the difference in diameter is insufficient to be engaged by the pipe string elevator 5 and support the weight of the hanging pipe from the vessel to the sea bed.

However, by engaging the detachable collar 2 around the upper end of the pipe 1, 4 and the flange collar 3, it is possible for the pipe string elevator 5 to engage flange 6 on the detachable collar 2 as a bearing support. This provides sufficient engagement for the elevator 5 to support the weight of the hanging pipe 1, 4 from the vessel to the sea bed without the flange collar 3 and the pipe string slipping out of the detachable collar 2.

With regard to the shape of the flange collar 3, it can be seen from FIG. 8 that the transition from the diameter of external section 10 to the increased diameter of formation 9 is a gradual one. Specifically, the diameter of the flange collar 3 increases continuously from said external section 10 to the diameter of formation 9, and with a continuous change in gradient, rather than an abrupt angle at the start of said transition.

The detachable collar 2 is shown in more detail in FIGS. 9 to 12. Detachable collar 2 includes two sections 11, 12 secured by a hinge pin 13 at one side. Each section 11, 12 has two flanges 14, 15 diametrically opposite the hinge pin 13. The flanges 14 have two bolt holes 16 and the flanges 15 have one bolt hole 17. The holes 16, 17 permit the flanges 14, 15 to be bolted together to secure the detachable collar 2 around the flange collar 3 and pipe 1, 4. The internal surface of the sections 11, 12 includes a machined recess 18 which engages with the machined formation 9 on the flange collar 3 to secure the detachable collar 2 to the flange collar 3 and the pipe 1, 4. Hence, when the pipe string elevator 5 engages and lifts flange 6 in use, the detachable collar 2 lifts the flange collar 3 and the pipe string attached to the flange collar 3.

Note that an end 50 of the flange collar 3 protrudes from the end of the detachable collar 2. This protruding end 50 allows the flange collar 3 to be welded to a second length of pipe 4.

FIGS. 16 to 20 show the support pedestal 7 in more detail. The support pedestal 7 includes two half sections 19, 20 which are connected together at one side by a hinge pin 21 which permits the two half sections 19, 20 of the support pedestal 7 to be opened using a hydraulic device or manual operation.

The support pedestal 7 has three support surfaces 22. Advantages of the invention are that by using the detachable collars 2, 30 (or any other detachable device such as a split flange) it is possible to reduce the size of the formation 9 on the flange collar 3. This minimises the stress concentrations in the steel catenary risers associated with a floating production platform such as a semi-submersible, a FPSO, a spar or a TLP, during the operation. In addition, the size of the formation 9 is such that after the detachable collar 2, 30 has been removed at the rig floor, the formation 9 may be removed from the lower flange collar 3 prior to lowering the pipe 1, 4 and the lower flange collar 3 below the drill floor towards the seabed. This can ameliorate the stress concentration problem.

This invention allows J-lay installation from a drilling vessel for the SCRs associated with floating platforms which move significantly and are subject to a harsh environment such as the North Sea. The J-lay method is not normally possible due to the stress concentration effect on the fatigue life limitation. Furthermore, the drilling vessel requires a major modification in order to use other methods of installation.

Modifications and improvements may be incorporated without departing from the scope of the invention.

For example, although the embodiments of the invention are described with reference to a drill rig, further embodiments can be used from a specially constructed lay system that does not have a drill floor because it does not do drilling operations and does not have a rotary table for the same reason. There are substantial advantages to laying from a specially designed system i.e. it can be made to fit so that pipe located on its upper end. Two of the support surfaces 22 are located on the upper end of the section 20 and one support surface 22 is located on the upper end of the section 19. The support surfaces 22 engage with and support the lower end of the detachable collar 2 (and the lower flange collar 3 and lower pipe 1 to which the lower flange collar 3 is welded) as shown in FIG. 3.

Figure 4:
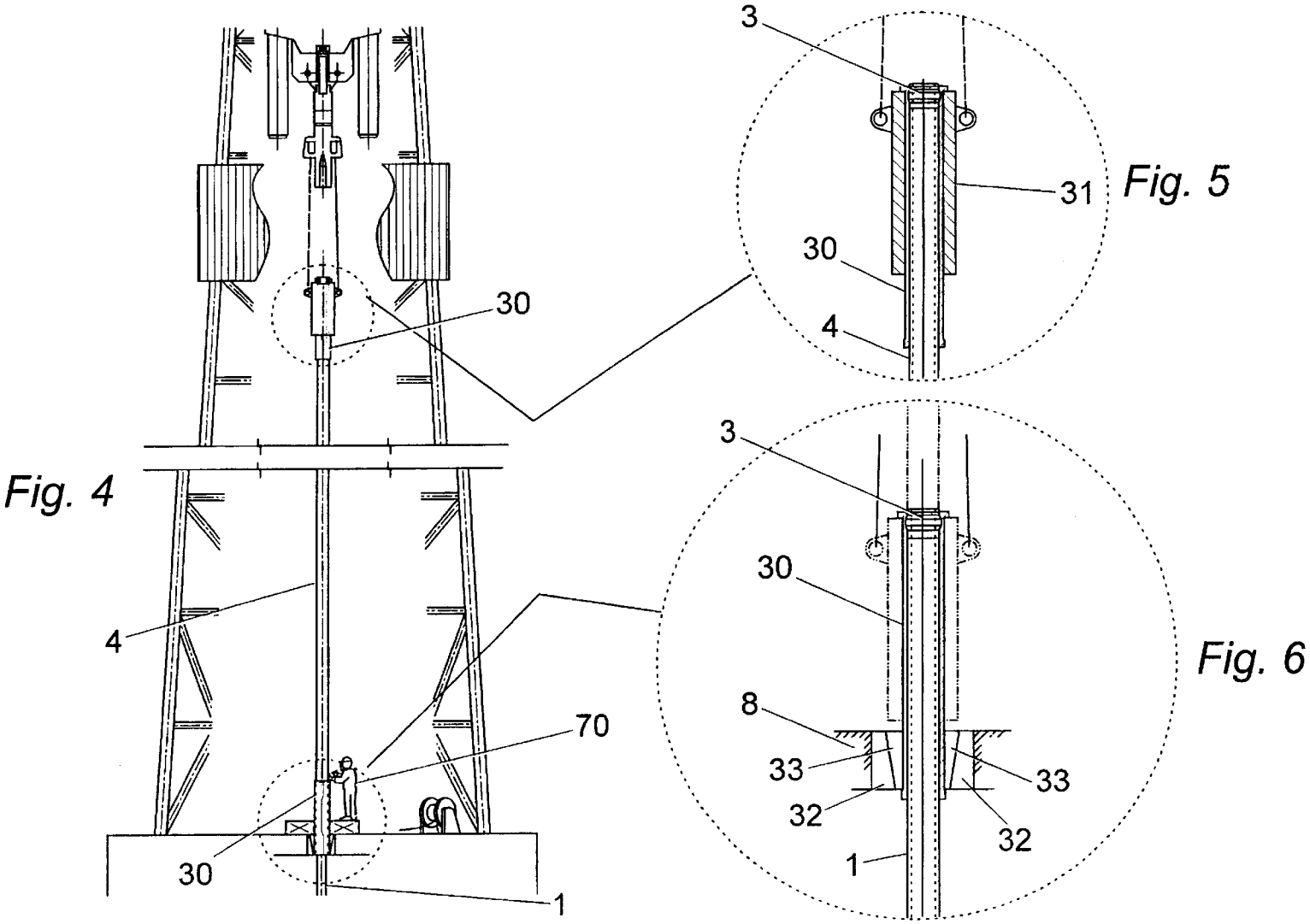
FIG. 4 is a schematic view of a general arrangement for supporting a length of pipe showing a second example of a detachable collar.

FIGS. 4 to 6 show a second example of a detachable collar 30 which is used and operated in a similar manner to the detachable collar 2 to engage and support the flange collar 3 and pipe 1, 4. However, in this example the detachable collar 30 is adapted to be engaged by a slip type elevator 31 which engages the detachable collar 30 in order to support the weight of the hanging pipe from the vessel to the sea bed. The detachable collar 31 is also supported by slips 32, 33 in the rotary table 8 (as opposed to being supported by the support pedestal 7).

Figure 14:
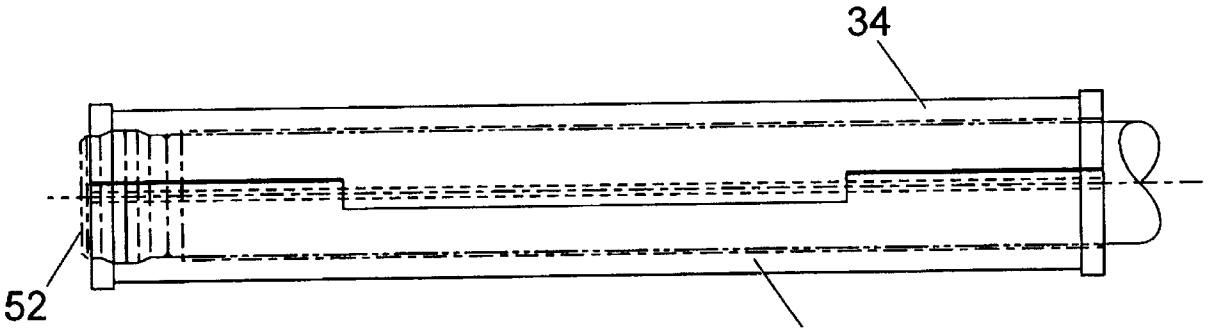
FIG. 14 is a side view of the detachable collar shown in FIG. 13.
Figure 15:
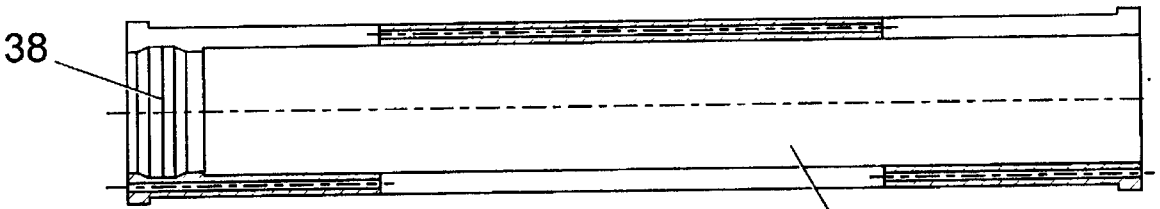
FIG. 15 is a cross-sectional view along the line A—A of the detachable collar shown in FIG. 14.
Figure 13:
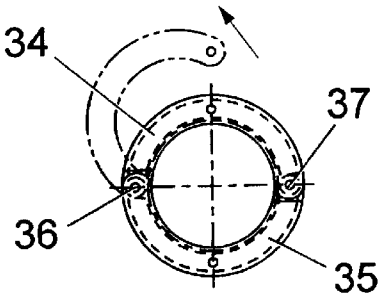
FIG. 13 is a end view of the second example of the detachable collar shown in FIGS. 4 to 6.
Figure 19:
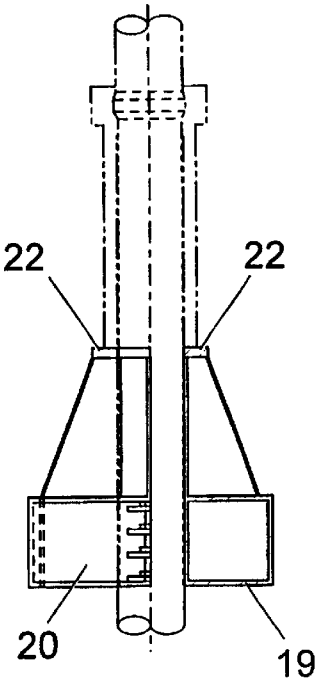
FIG. 19 is a part cross-sectional view of the support pedestal in the direction of the arrow A in FIG. 17; and, FIG. 20 is a plan view of the support pedestal.
Figure 18:
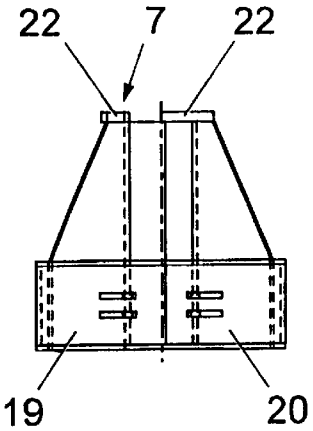
FIG. 18 is a side view of the support pedestal in the direction of the arrow B in FIG. 17.
Figure 17:
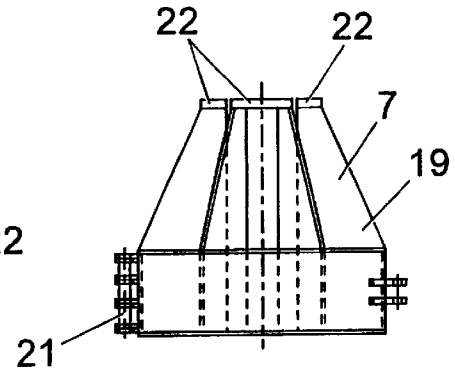
FIG. 17 is a side view of the support pedestal shown in FIG. 16.
Figure 16:
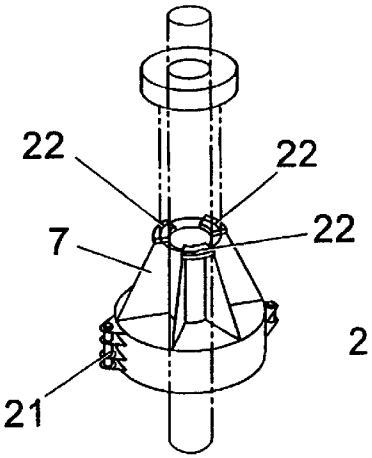
FIG. 16 is a perspective view showing a general arrangement of a support pedestal for the first example of the detachable collar.
Figure 20:
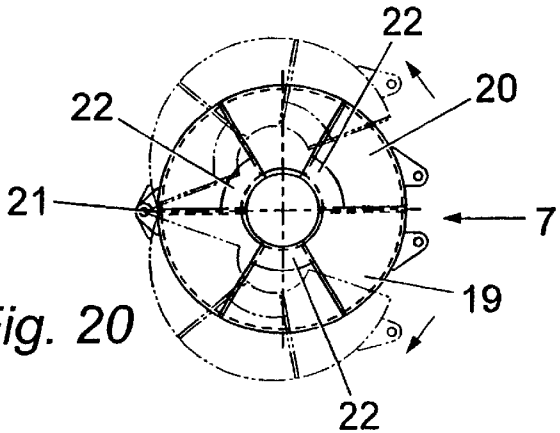

As shown in FIGS. 13 to 15, the detachable collar 30 comprises two half sections 34, 35 which are coupled at one side by a hinge pin 36 and secured at the other side by a lock pin 37. The detachable collar 30 includes a recess 38 on its internal surface which engages with the formation 9 on the flange collar 3. The other features and the operation of the detachable collar 30 are similar to the other features and operation of the detachable collar 2.

Note that an end 52 of the flange collar 3 protrudes from the end of the detachable collar 2. This protruding end 52 allows the flange collar 3 to be welded to a second length of pipe 4, similar to the protruding end 50 in FIG. 9. can be laid in relatively shallow water.

What is claimed is:

1. Apparatus for supporting a tubular member comprising a first member comprising a first formation, the first member being adapted to be attached to the tubular member, and a detachable member adapted to engage the first formation; the detachable member having an internal formation which engages with the first formation, and an external formation for engagement by a lifting device to support the tubular member when the detachable member is placed around the tubular member and the internal formation is engaged with the first formation.

2. Apparatus according to claim 1, wherein the detachable member is adapted to engage a portion of the tubular member adjacent the first formation.

3. Apparatus according to either preceding claim, wherein the detachable member is placed around a portion of the tubular member adjacent the first formation.

4. Apparatus as claimed in claim 1, wherein the detachable member is hinged along an axis substantially parallel to the central longitudinal axis of the detachable member and/or the tubular member.

5. Apparatus as claimed in claim 1, wherein, the detachable member includes a clamp to secure it to the first formation.

6. Apparatus as claimed in claim 1, wherein the first member comprises a collar.

7. Apparatus as claimed in claim 1, wherein the first member is coupled to the tubular member by welding.

8. Apparatus as claimed in claim 1, wherein the first formation is in the form of a protrusion on the first member.

9. Apparatus as claimed in claim 1, wherein the tubular member is supported with the central longitudinal axis of the tubular member in a substantially vertical orientation.

10. Apparatus as claimed in claim 1 wherein the external formation on the detachable member provides a bearing support for engagement with the lifting device to support the tubular member, and the first formation is of reduced size in comparison with the external formation of the detachable member, such that stress concentration in the tubular member around the location of the first formation is reduced compared with stress concentration in a comparable tubular member having the bearing support formed directly thereon.

11. Apparatus as claimed in claim 10 wherein the first member is tubular having internal and external diameters substantially the same as the tubular member being supported, the first formation comprising a portion of increased external diameter.

12. Apparatus as claimed in claim 11 wherein said first formation is shaped such that the diameter of the first member increases continuously from the external diameter of the tubular member to said increased external diameter.

13. Apparatus as claimed in claim 11 wherein said first formation is shaped such that the increase in the diameter of the first member from the external diameter of the tubular member to said increased external diameter starts with a continuous change in gradient.

14. A method of supporting a tubular member comprising attaching to the tubular member a first member comprising a first formation, placing a detachable member against the first formation so that the first formation engages an internal formation on the detachable member; and engaging an external formation on the detachable member with a lifting device to support the tubular member.

15. A method according to claim 14, further including the step of fixing the tubular member or the first member to another tubular member and subsequently detaching the detachable member from the first tubular member.

16. A method according to either claim 14 or claim 15, wherein the tubular member is supported with the central longitudinal axis of the tubular member in a substantially vertical orientation.

17. A method of laying underwater pipeline comprising a method of supporting a first tubular member according to claim 14, comprising attaching another tubular member also supported by a method according to claim 14 to the first tubular member or the first member, such that the tubular members are in end to end relationship and the central longitudinal axes of the tubular members are substantially coincident, releasing the detachable member engaged with the first formation on the first tubular member, and lowering the tubular members by means of the lifting device attached to the second detachable member to lower the tubular members towards the seabed.

18. A method according to claim 14, wherein the first member is attached to an end of the tubular member.

19. A method according to claim 14, wherein the first member is attached to an external surface of the first tubular member.

20. A method according to claim 14, wherein the first member is attached to the tubular member by welding.

21. A method according to claim 17, wherein the other tubular member is attached to the first tubular member or the first member.

22. A method according to claim 14, wherein the method of laying an underwater pipeline comprises laying the underwater pipeline from a semisubmersible vessel or floating vessel.

23. A method according to claim 22, wherein the semi-submersible or floating vessel comprises a semi-submersible drilling rig, a floating production platform or a tensioned leg platform.

24. A method according to claim 14, wherein the method includes the step of removing the first formation from the first member after detachment of the detachable member.

25. A method according to claim 24, wherein the formation is removed by machining or reaming.

26. A method according to claim 22, wherein the detachable member is supported on a support pedestal located on the drill floor of the platform or vessel.

27. A method according to claim 22, wherein the detachable member is adapted to engage with and be supported by slips located in a rotary table on the platform or vessel.

28. A method according to claim 14, wherein the detachable member is hinged along an axis substantially parallel to the central longitudinal axis of the detachable member and the tubular member.

29. A method according to claim 14, wherein when placed around the formation and/or the portion of the tubular member adjacent to the formation, the detachable member is clamped to the first formation and/or the portion of the tubular member adjacent the first formation.

30. A method according to claim 14 wherein the external formation on the detachable member provides a bearing support for engagement with the lifting device to support the tubular member, and the first formation is of reduced size in comparison with the external formation of the detachable member, such that stress concentration in the tubular member around the location of the first formation is reduced compared with stress concentration in a comparable tubular member having the bearing support formed directly thereon.

31. A method according to claim 14 wherein the first member is tubular having internal and external diameters substantially the same as the tubular member being supported, the first formation comprising a portion of increased external diameter.

32. Apparatus according to claim 31 wherein said first formation is shaped such that the diameter of the first member increases continuously from the external diameter of the tubular member to said increased external diameter.

33. Apparatus according to claim 31 wherein said first formation is shaped such that the increase in the diameter of the first member from the external diameter of the tubular member to said increased external diameter starts with a continuous change in gradient.

* * * * *